US012680315B2

(12) United States Patent
Boo

(10) Patent No.: US 12,680,315 B2
(45) **Date of Patent: *Jul. 14, 2026**

(54) BUILDING PANELS COMPRISING A LOCKING SYSTEM

(71) Applicant: Välinge Innovation AB, Viken (SE)

(72) Inventor: Christian Boo, Kagerod (SE)

(73) Assignee: VÄLINGE INNOVATION AB, Viken (SE)

( * ) Notice: Subject to any disclaimer, the term of this patent is extended or adjusted under 35 U.S.C. 154(b) by 47 days.

This patent is subject to a terminal disclaimer.

(21) Appl. No.: 18/661,952

(22) Filed: May 13, 2024

(65) Prior Publication Data

US 2024/0309651 A1 Sep. 19, 2024

Related U.S. Application Data

(63) Continuation of application No. 17/220,101, filed on Apr. 1, 2021, now Pat. No. 12,006,701.

(30) Foreign Application Priority Data

Apr. 7, 2020 (SE) ..... 2050396-7

(51) Int. Cl.
*E04F 15/02* (2006.01)
*E04F 13/08* (2006.01)
(Continued)

(52) U.S. Cl.
CPC .... *E04F 15/02038* (2013.01); *E04F 13/0894* (2013.01); *E04F 15/04* (2013.01);
(Continued)

(58) Field of Classification Search
CPC . E04F 15/02038; E04F 13/0894; E04F 15/04; E04F 2201/0153; E04F 2201/023;
(Continued)

(56) References Cited

U.S. PATENT DOCUMENTS 6,247,285 B1 6/2001 Moebus
6,332,733 B1 12/2001 Hamberger et al.
(Continued)

FOREIGN PATENT DOCUMENTS

CN 101910528 A 12/2010
CN 109025152 A 12/2018
(Continued)

OTHER PUBLICATIONS

U.S. Appl. No. 17/220,101, filed Apr. 1, 2021, Christian Boo.
(Continued)

*Primary Examiner* — Brent W Herring
(74) *Attorney, Agent, or Firm* — Boone IP Law

(57) ABSTRACT

Building panels including a locking system for locking of a first edge portion to an adjacent second edge portion. The locking system includes a tongue and a tongue groove configured to cooperate for vertical locking. The tongue groove includes an upper and a lower lip protruding horizontally beyond the upper lip. In a locked state of the building panels an outer end portion of a lower vertical locking surface of the tongue is provided horizontally closer than an outer end portion of an upper vertical locking surface of the upper lip to a locking element provided on a strip extending beyond an upper portion of the first edge portion. Alternatively, or additionally, an inner end portion of a lower vertical locking surface of the lower lip is provided horizontally closer than an inner end portion of an upper vertical locking surface of the tongue to the locking element.

18 Claims, 3 Drawing Sheets

(51) Int. Cl.
*E04F 15/04* (2006.01)
*E04F 15/20* (2006.01)

(52) U.S. Cl.
CPC ..... *E04F 15/20* (2013.01); *E04F 2201/0115* (2013.01); *E04F 2201/0153* (2013.01); *E04F 2201/023* (2013.01); *E04F 2201/043* (2013.01)

(58) Field of Classification Search
CPC ..... E04F 2201/043; E04F 2201/0115; E04F 2201/0161; E04F 15/102; E04F 15/105; E04F 15/20; E04F 15/206; E04F 2201/03; E04F 2201/035
USPC ..... 52/588.1
See application file for complete search history.

(56) References Cited

U.S. PATENT DOCUMENTS

| | | | | |
|---|---|---|---|---|
| 6,497,079 | B1 | 12/2002 | Pletzer et al. | |
| 6,647,689 | B2 | 11/2003 | Pletzer et al. | |
| 7,516,588 | B2 * | 4/2009 | Pervan | B27F 5/026 52/592.1 |
| 7,603,826 | B1 | 10/2009 | Moebus | |
| 7,707,792 | B2 | 5/2010 | Steele et al. | |
| 7,980,043 | B2 | 7/2011 | Moebus | |
| 8,028,486 | B2 | 10/2011 | Pervan et al. | |
| 8,495,849 | B2 | 7/2013 | Pervan | |
| 8,763,340 | B2 | 7/2014 | Pervan et al. | |
| 9,322,183 | B2 | 4/2016 | Pervan | |
| 9,574,354 | B2 | 2/2017 | Stevens, Jr. | |
| 9,777,487 | B2 * | 10/2017 | Pervan | E04F 15/107 |
| 9,816,270 | B2 | 11/2017 | Pervan et al. | |
| 10,138,637 | B2 | 11/2018 | Pervan | |
| 10,697,175 | B2 | 6/2020 | Pervan et al. | |
| 10,801,213 | B2 | 10/2020 | Nilsson | |
| 10,830,268 | B2 * | 11/2020 | Boo | F16B 12/46 |
| 10,941,578 | B2 | 3/2021 | Nilsson | |
| 2002/0057942 | A1 | 5/2002 | Hamberger et al. | |
| 2003/0154681 | A1 | 8/2003 | Pletzer et al. | |
| 2004/0250492 | A1 | 12/2004 | Becker | |
| 2005/0166514 | A1 * | 8/2005 | Pervan | B27M 3/04 52/578 |
| 2009/0038254 | A1 | 2/2009 | Steele et al. | |
| 2009/0133353 | A1 | 5/2009 | Pervan et al. | |
| 2012/0174521 | A1 | 7/2012 | Schulte | |
| 2013/0333182 | A1 | 12/2013 | Pervan et al. | |
| 2017/0254076 | A1 | 9/2017 | Pervan et al. | |
| 2019/0211568 | A1 | 7/2019 | Nilsson | |
| 2020/0181923 | A1 | 6/2020 | Quist et al. | |
| 2020/0263439 | A1 | 8/2020 | Nilsson | |
| 2020/0284034 | A1 | 9/2020 | Pervan et al. | |
| 2023/0220680 | A1 | 7/2023 | Pervan et al. | |

FOREIGN PATENT DOCUMENTS

| | | | |
|---|---|---|---|
| CN | 109025154 | A | 12/2018 |
| DE | 20002413 | U1 | 4/2000 |
| DE | 19962830 | A1 | 7/2001 |
| DE | 102010024513 | A1 | 12/2011 |
| DE | 102011055949 | A1 | 6/2013 |
| DE | 202015008925 | U1 | 3/2016 |
| DE | 202016105667 | U1 | 11/2016 |
| EP | 1169528 | A1 | 1/2002 |
| EP | 1440214 | A1 | 7/2004 |
| EP | 3271527 | A1 | 1/2018 |
| SI | 1169528 | T1 | 2/2003 |
| WO | 01/66876 | A1 | 9/2001 |
| WO | 2004/079130 | A1 | 9/2004 |
| WO | 2008/064692 | A1 | 6/2008 |
| WO | 2013/191632 | A1 | 12/2013 |
| WO | 2016/146112 | A1 | 9/2016 |
| WO | 2019/154929 | A1 | 8/2019 |

OTHER PUBLICATIONS

U.S. Appl. No. 17/932,902, filed Sep. 16, 2022, Darko Pervan.
U.S. Appl. No. 19/015,890, filed Jan. 10, 2025, Christian Boo.
U.S. Appl. No. 18/912,920, filed Oct. 11, 2024, Anders Nilsson.
U.S. Appl. No. 18/912,910, filed Oct. 11, 2024, Anders Nilsson.
International Search Report and Written Opinion mailed May 6, 2021 in PCT/SE2021/050301, ISA/SE, Stockholm, SE, 14 pages.
Office Action received for Chinese Patent Application No. 202180025330.4, mailed on Jan. 17, 2024, 15 pages (10 pages of English Translation and 5 pages of Original Document).
Supplementary European Search Report and Search Opinion received for European Applicaton No. 21785200, mailed on Apr. 12, 2024, 11 pages.
Swedish Office Action issued in SE 2050396-7, Oct. 5, 2020, PRV, Stockholm, SE, 9 pages.

* cited by examiner

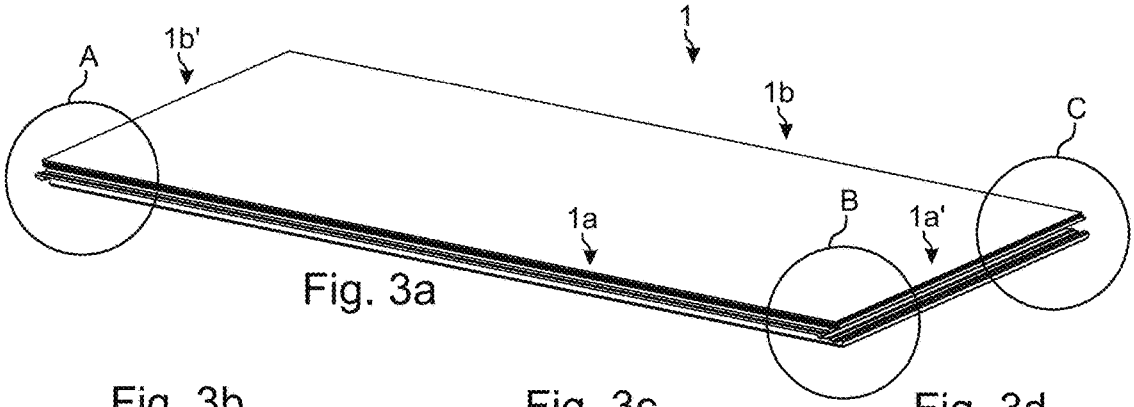
Fig. 3a
Fig. 3b
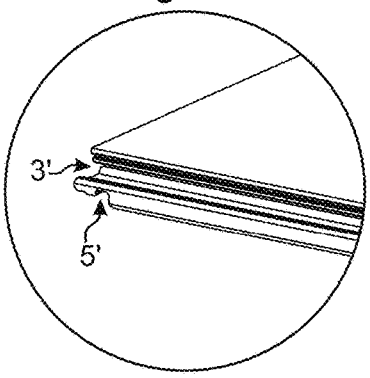
Fig. 3c
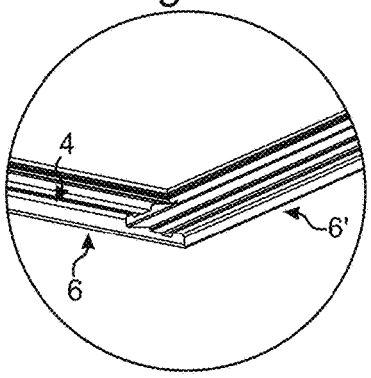
Fig. 3d
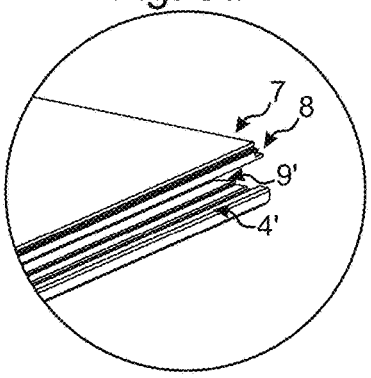
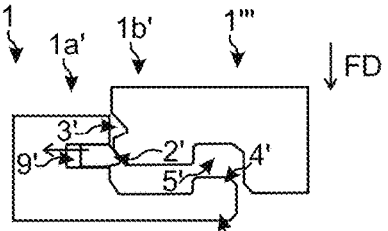
Fig. 3e
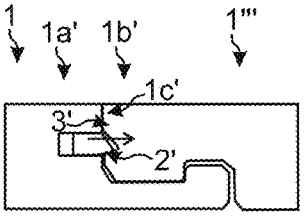
Fig. 3f
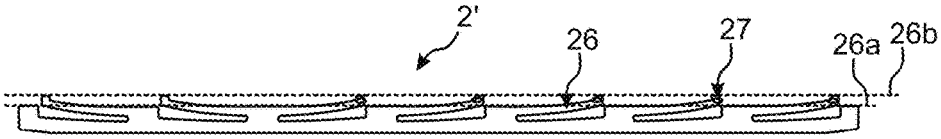
Fig. 3g
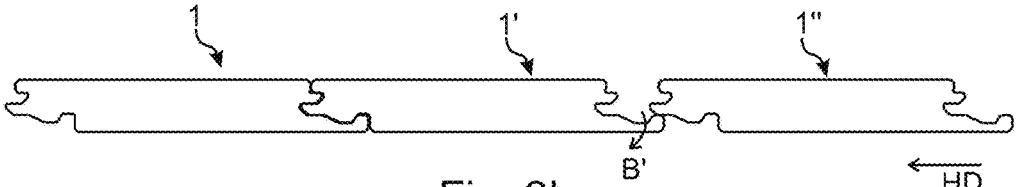
Fig. 3h

BUILDING PANELS COMPRISING A LOCKING SYSTEM

CROSS REFERENCE TO RELATED APPLICATIONS

The present application is a continuation of U.S. application Ser. No. 17/220,101, filed on Apr. 1, 2021, which claims the benefit of Swedish Application No. 2050396-7 filed on Apr. 7, 2020. The entire contents of U.S. application Ser. No. 17/220,101 and Swedish Application No. 2050396-7 are hereby incorporated herein by reference in their entirety.

TECHNICAL FIELD

The disclosure generally relates to building panels, such as floor panels, comprising a locking system, preferably a mechanical locking system. More specifically, the disclosure relates to building panels comprising a locking system preferably being formed in one piece with a core of the building panels and preferably being configured to be assembled by angling. The building panels may be floor panels, preferably being configured to provide a floating floor.

BACKGROUND

WO 2013/191632 A1 discloses building panels provided with a locking system for locking of a first edge of a first building panel to an adjacent second edge of a second building panel. The locking system comprises a tongue and a tongue groove configured to cooperate for vertical locking. The first edge comprises a strip provided with a locking element, which is configured to cooperate with a locking groove formed in the second edge for horizontal locking. The tongue protrudes outwardly beyond a vertical plane provided along the joint edges and the tongue groove comprises a lower and an upper lip. A horizontal extension of the lower lip in relation to the upper lip is smaller than a horizontal extension of the tongue.

An advantage of this type of locking system is that the adjacent edges may easily be guided into a proper position during assembly. Moreover, the locking system may provide a high locking strength and, additionally, it is possible to reduce material waste when forming the locking system. When the tongue cooperates with the lower lip as well as the upper lip at lower and upper vertically locking surfaces, a twofold seal may be provided.

Despite these and many other advantages of this type of locking system, however, there is still room for improvements, such as an improvement of its sound properties.

SUMMARY

It is therefore an object of at least embodiments of the present disclosure to provide building panels comprising a locking system in which the risk and/or intensity of noise and/or creaking is reduced.

Another object is to provide such building panels while maintaining, or preferably improving, one or more characteristics of the locking system, such as its sealing property, locking strength, guiding ability, etc.

These and other objects and advantages that will be apparent from the description have been achieved by the various aspects, embodiments and examples described below.

In accordance with a first aspect of the present disclosure, there is provided building panels comprising a locking system for vertical and horizontal locking of a first edge portion of a first building panel to an adjacent second edge portion of a second building panel. In a locked state of the first and second building panels upper portions of the first and second edge portions together define a vertical plane VP perpendicular to a horizontal plane HP, which is parallel to a front side and/or a rear side of the building panels. The locking system comprises a tongue provided in the first edge portion and a tongue groove provided in the second edge portion configured to cooperate, such as engage, for vertical locking. The tongue groove comprises an upper lip and a lower lip, preferably protruding horizontally beyond the upper lip, wherein the tongue is configured to cooperate with the upper lip at upper vertical locking surfaces and with the lower lip at lower vertical locking surfaces. The locking system comprises a locking element provided in the first edge portion and a downwardly open locking groove provided in the second edge portion configured to cooperate, such as engage, for horizontal locking, wherein the locking element is provided on a strip extending beyond the upper portion of the first edge portion.

In the locked state of the first and second building panels an outer end portion of a lower vertical locking surface of the tongue is provided horizontally closer than an outer end portion of an upper vertical locking surface of the upper lip to the locking element. Alternatively, or additionally, in the locked state of the first and second building panels an inner end portion of a lower vertical locking surface of the lower lip may be provided horizontally closer than an inner end portion of an upper vertical locking surface of the tongue to the locking element.

In accordance with the present disclosure, the upper and lower vertical locking surface(s) may overlap horizontally. For example, the lower vertical locking surface(s) may extend further into the tongue groove. Thereby, the risk of a vertical relative displacement and/or tilting of the building panels when subjected to a load may be reduced. As a consequence, the noise and/or the creaking of the building panels may be reduced, such as when they are loaded. For example, building panels in the form of floor panels may be subjected to a load when a person walks on them.

Generally herein, the wording "up, upper or upward", etc., may be a direction or position toward a front side of the panel and "down, lower or downward", etc., may be a direction or position toward the rear side. The wording "inner, inwardly", etc., may be a, preferably horizontal, direction or position towards a centre of the panel and the wording "outer, outwardly", etc., may be a, preferably horizontal, direction or position away from the centre of the panel.

The outer end portion of the lower vertical locking surface may be an outermost portion of the lower vertical locking surface. The outer end portion of the upper vertical locking surface may be an outermost portion of the upper vertical locking surface. The inner end portion of the upper vertical locking surface of the tongue may be spaced from the vertical plane. The inner end portion of the lower vertical locking surface of the lower lip may be spaced from an innermost portion of the tongue groove.

A horizontal extension, such as a maximal horizontal extension, of the lower vertical locking surface of the tongue and/or of the lower vertical locking surface of the lower lip may be larger than a horizontal extension, such as a maximal horizontal extension, of the upper vertical locking surface of the upper lip and/or of the upper vertical locking surface of the tongue.

The locking element and the locking groove may cooperate at horizontal locking surfaces.

Generally herein, horizontal and/or vertical locking surfaces may cooperate by direct engagement or indirectly. In any embodiment described herein, there may be a sealing agent, such as a wax or an adhesive, provided between the locking surfaces, thereby providing examples of an indirect engagement.

Each of the horizontal locking surfaces may be essentially planar.

In the locked state of the building panels each of the horizontal locking surfaces may be spaced vertically and/or horizontally from a linking portion in the first building panel provided at an inner base of the locking element.

The horizontal locking surfaces may extend, such as extend entirely, below a horizontal strip plane provided along an upper strip surface disposed inwardly of the locking element.

The locking element and/or a protrusion of the second edge portion may comprise a bevel, wherein the protrusion is configured to be provided in a recess of the first edge portion, preferably in the locked state.

The locking system may be configured to assemble the first and second edge portions by angling of the first and second building panels relative each other. Alternatively, or additionally, the locking system may be configured to assemble the first and second edge portions by a horizontal displacement of the first and second building panels relative each other.

During angling an angular displacement may occur between two portions that are being assembled or disassembled. When angling relates to assembly of two floor panels, the angular motion may generally occur when upper portions of joint edge portions at least partly engage with each other, during at least a part of the displacement.

The building panel may comprise a core and, optionally, a top layer and/or a balancing layer. For example, the top layer may comprise a decorative layer and/or a protective layer, such as a wear layer, lacquer or wax.

The tongue and/or the strip may be formed in one piece with a core of the building panels. Preferably, also the upper and/or the lower lips are formed in one piece with the core.

A horizontal, preferably maximal, extension of the tongue from the vertical plane may be larger than a horizontal, preferably maximal, extension of the lower lip from the vertical plane and/or the upper lip. Alternatively, the horizontal, preferably maximal, extension of the lower lip from the vertical plane and/or the upper lip may be larger than the horizontal, preferably maximal, extension of the tongue from the vertical plane.

The upper and lower vertical locking surfaces may be essentially parallel with the horizontal plane.

The upper and lower vertical locking surfaces may be offset horizontally such that the upper vertical locking surfaces are provided horizontally closer than the lower vertical locking surfaces to the locking element.

The locking system may further comprise outer vertical locking surfaces provided horizontally outside of the tongue in the locked state. By having contact, such as permanent contact, between the outer vertical locking surfaces, whereby a portion of the strip and an underside portion of the second edge portion may move in unison when the panels are subjected to a load, the risk and/or intensity of noise and/or creaking may be reduced even further.

The outer vertical locking surfaces may extend inwardly of the locking element in the locked state. Preferably, they extend entirely inwardly of the locking element.

The outer vertical locking surfaces may be provided in an upper portion of the locking element and in a lower portion of the locking groove.

The locking system may comprise a space between an upper portion of the strip and a lower edge portion of the second edge portion.

The space may extend under an entirety of the lower lip, and from under the lower lip to the locking element.

A core of each of the building panels may be a wood-based core, such as comprising an HDF board, a particle board or a plywood material.

A core of each of the building panels may be a polymer-based core, such as comprising a thermoplastic material, and preferably a filler, or a thermosetting material. For example, the thermoplastic material may comprise PVC and the thermosetting material may comprise a melamine formaldehyde resin.

A core of each of the building panels may be a mineral-based core, such as comprising magnesium oxide and, optionally, magnesium chloride (e.g., $MgCl_2$) and/or magnesium sulfate (e.g., $MgSO_4$).

The building panels may be essentially identical.

The building panels may be rectangular, thereby comprising a pair of long side edges and short side edges. Preferably, the locking system is provided on the long side edges. Alternatively, or additionally, however, the locking system may be provided on the short side edges. The panels may be configured to be assembled by angling on the long side edges and, optionally, on the short side edges. Preferably, however, the short side edges are assembled by a vertical folding displacement.

In accordance with a second aspect of the present disclosure, there is provided building panels comprising a locking system for vertical and horizontal locking of a first edge portion of a first building panel to an adjacent second edge portion of a second building panel. Upper portions of the first and second edge portions in a locked state of the first and second building panels together define a vertical plane perpendicular to a horizontal plane, which is parallel to a front side (1*e*) and/or a rear side of the building panels. The locking system comprises a tongue provided in the first edge portion and a tongue groove provided in the second edge portion, wherein the tongue and the tongue groove are configured to cooperate for vertical locking. The tongue groove comprises an upper lip and a lower lip, wherein the tongue is configured to cooperate with the upper lip at upper vertical locking surfaces and with the lower lip at lower vertical locking surfaces. The locking system comprises a locking element provided in the first edge portion and a downwardly open locking groove provided in the second edge portion, wherein the locking element and the downwardly open locking groove are configured to cooperate for horizontal locking and wherein the locking element is provided on a strip extending beyond the upper portion of the first edge portion. The locking system further comprises outer vertical locking surfaces provided horizontally outside of the tongue in the locked state.

As described above, by having contact, such as permanent contact, between the outer vertical locking surfaces, whereby a portion of the strip and an underside portion of the second edge portion may move in unison when the panels are subjected to a load, the risk and/or intensity of noise and/or creaking may be reduced.

Embodiments and examples of the second aspect are largely analogous to embodiments and examples of the first aspect, whereby reference is made thereto.

Aspects of the disclosure has mainly been described above with reference to a few embodiments. However, as is readily appreciated by a person skilled in the art, other embodiments than the ones disclosed above are equally possible within the scope of aspects of the disclosure.

Generally, all terms used in the claims and in the items in the embodiment section below are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise. Reference to one or a plurality of "at least one element", etc., may shortly be referred to as "the element(s)".

BRIEF DESCRIPTION OF THE DRAWINGS

The disclosure will in the following be described in connection to exemplary embodiments and in greater detail with reference to the appended exemplary drawings, wherein:

FIGS. 3*a*-3*d* illustrate exemplary embodiments of a building panel in a perspective view (in FIG. 3*a*) and in zoomed-in perspective views of the areas A, B and C indicated in FIG. 3*a* (in FIGS. 3*b*-3*d*).

FIGS. 3*e*-3*f* illustrate, in side views, exemplary embodiments of a building panel and an adjacent building panel during assembly and in a locked state.

FIG. 3*g* illustrates an exemplary embodiment of a separate and flexible tongue in a top view.

FIG. 3*h* illustrates, in a cross-sectional side view, an exemplary embodiment of building panels that are being assembled.

DETAILED DESCRIPTION

Next, various embodiments of building panels 1, 1', 1" will be described with reference to FIGS. 1*a*-1*e*, 2*a*-2*e* and 3*a*-3*h*.

Figure 1A:
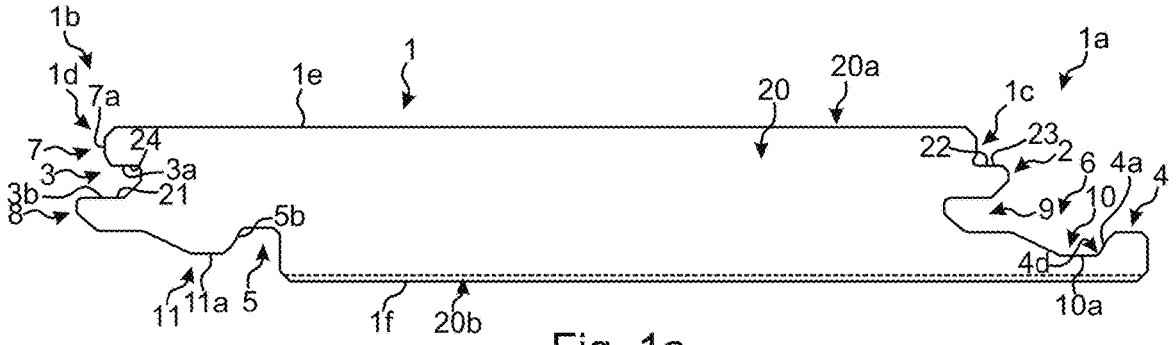
FIG. 1*a* illustrates an exemplary embodiment of a building panel in a cross-sectional side view.
Figure 1B:
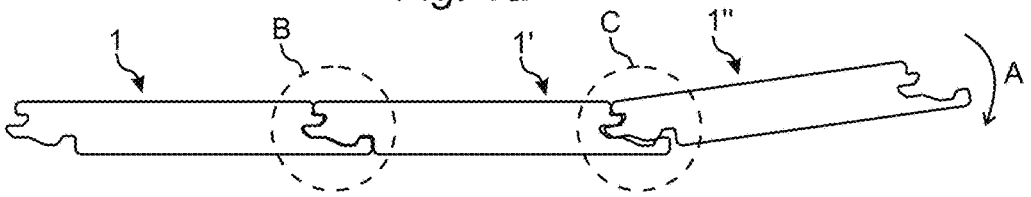
FIG. 1*b* illustrates, in a cross-sectional side view, an exemplary embodiment of locked building panels as well as building panels that are being assembled.

FIG. 1*a* illustrates an embodiment of a building panel 1 comprising a locking system, preferably a mechanical locking system, for vertical and horizontal locking. Preferably, the building panel is a floor panel, but other building panels are equally conceivable, such as a wall panel or a furniture panel.

A first edge portion 1*a* of the panel 1 comprises a tongue 2 and a locking element 4 provided on a strip 6. The strip 6 extends horizontally beyond an upper portion 1*c* of the first edge portion 1*a*. The tongue 2, the locking element 4 and the strip 6 may extend along a longitudinal direction of the first edge portion 1*a*, i.e., along a direction which is perpendicular to the cross-sectional plane in FIG. 1*a* (i.e., "into the paper"), preferably along essentially the entirety of the first edge portion 1*a*.

A second edge portion 1*b* of the panel 1 comprises a tongue groove 3 and a downwardly open locking groove 5. The tongue groove 3 comprises an upper lip 7 and a lower lip 8 protruding horizontally beyond the upper lip. Thereby, the assembly of panels 1, 1' may become simplified, since the lower lip 8 may provide an improved guiding of an adjacent second panel 1' with respect to the first panel 1, see, e.g., FIGS. 1*b* and 1*d*. The tongue groove 3 and the locking groove 5 may extend along a longitudinal direction of the second edge portion 1*b*, preferably along essentially its entirety.

The tongue 2 and/or the strip 6 may be formed in one piece with a core 20 of the panel 1. Optionally, the panel 1 may comprise a top layer 20*a* and/or a balancing layer 20*b*. The core 20 may be a wood-based core, such as comprising an HDF board, a particle board or a plywood material. Alternatively, the core 20 may be a polymer-based core, such as comprising a thermoplastic material or a thermosetting material. Yet alternatively, the core 20 may be a mineral-based core, e.g., comprising magnesium oxide. In first examples, the panel may be a laminate panel or a parquet panel. In second examples, the panel may be a flexible polymeric panel, such as a Luxury Vinyl Tile (LVT), or a rigid polymeric panel, such as a so called Stone Plastic (Polymer) Composite (SPC) flooring panel. An LVT tile and an SPC panel may comprise PVC, a filler, such as chalk or stone powder, and additives. In third examples, the panel may comprise an HDF board, at least one powder-based layer, preferably comprising wood fibres, and optionally, a veneer layer provided on the powder-based layer. The panel may comprise a balancing layer, such as a powder backing layer, which may optionally further comprise a veneer layer.

Figure 1C:
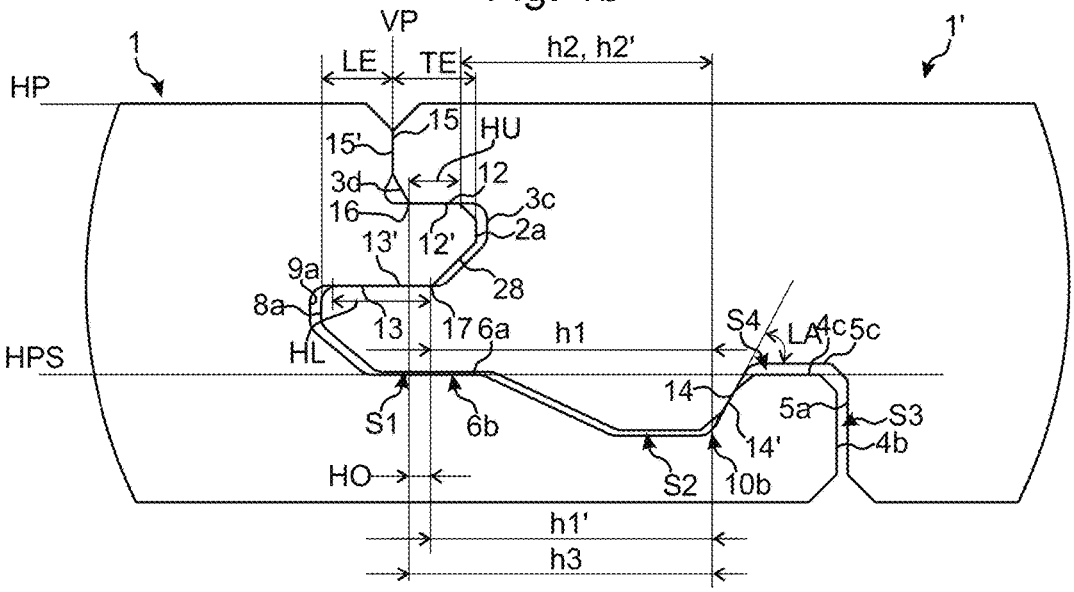
FIG. 1*c* illustrates an exemplary embodiment of locked building panels zoomed-in around the region B in FIG. 1*b*.
Figure 1D:
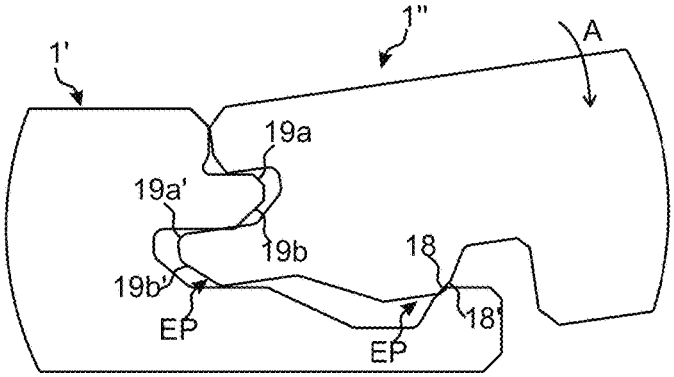
FIG. 1*d* illustrates an exemplary embodiment of building panels that are being assembled zoomed-in around the region C in FIG. 1*b*.
Figure 1E:
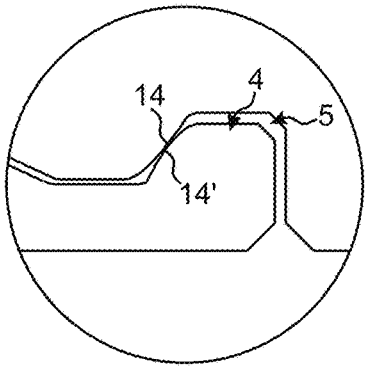
FIG. 1*e* illustrates, in a zoomed-in cross-sectional side view, an exemplary embodiment of locked building panels.
Figure 2A:
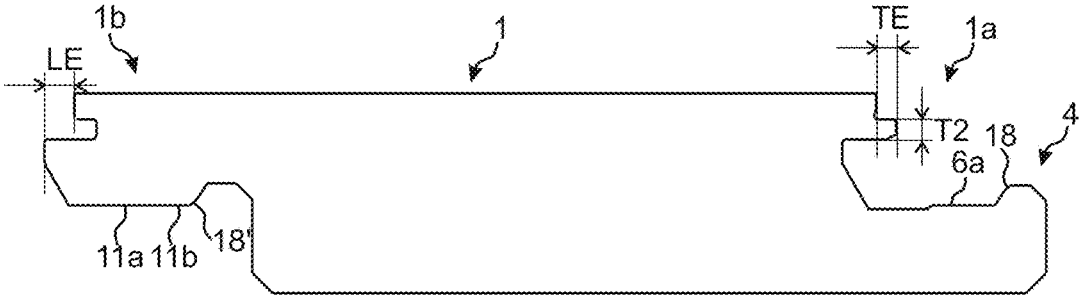
FIGS. 2*a*-2*e* illustrate exemplary embodiments of building panels in cross-sectional side views; the embodiments in the zoomed-in cross-sectional side views in FIGS. 2*c* and 2*e* illustrate locked building panels of the type in FIGS. 2*b* and 2*d*, respectively.
Figure 2B:
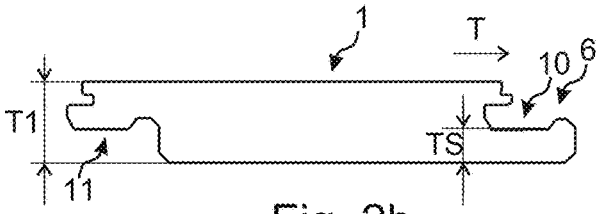
Figure 2C:
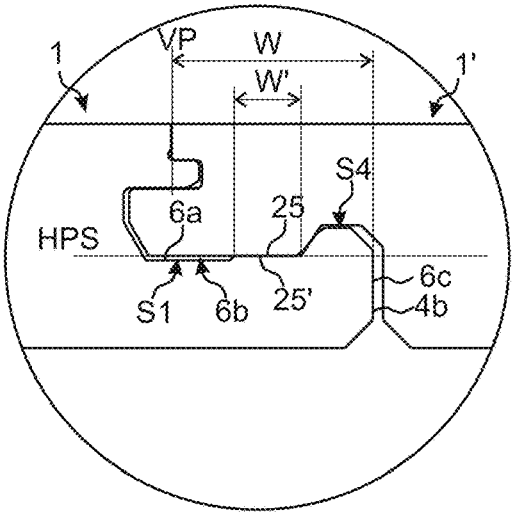
Figure 2D:
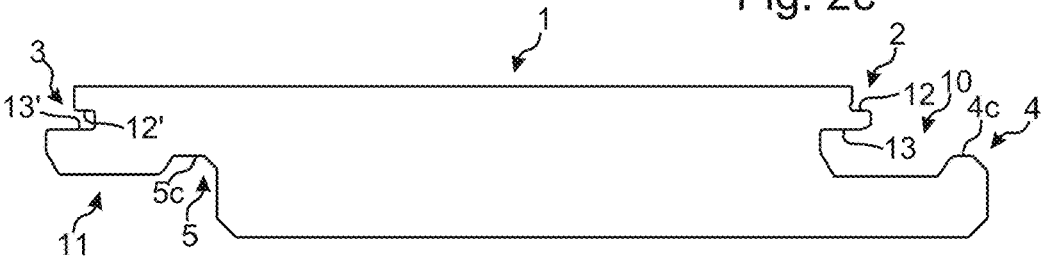
Figure 2E:
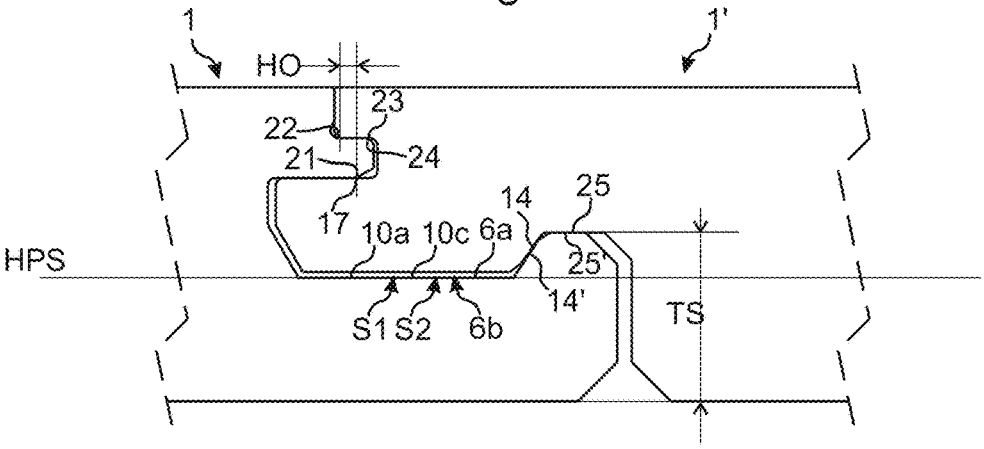

In a locked state of a pair of building panels 1, 1', and as shown for example in FIGS. 1*c*, 2*c* and 2*e*, upper portions 1*c*, 1*d* of the first 1*a* and second 1*b* edge portions together define a vertical plane VP perpendicular to a horizontal plane HP, which is parallel to a front side 1*e* and/or a rear side 1*f* of the panels. Preferably, the locking system is configured to assemble the first 1*a* and second 1*b* edge portions by angling A of a first panel 1 and a second panel 1' relative each other, as shown for example in FIG. 1*b*. Alternatively, or additionally, however, and as shown in FIG. 3*h*, the panels 1, 1' may be configured to assemble the first 1*a* and second 1*b* edge portions by a horizontal displacement HD of the first 1 and second 1' panels towards each other, such as by a snapping engagement. The strip 6 may be configured to be bent downwards B' during the assembly. Such a horizontal displacement HD is also equally conceivable for the panels 1, 1' in, e.g., FIGS. 1*a*-1*e*, 2*a*-2*e* and 3*a*-3*f*.

The tongue 2 may protrude outwardly beyond the vertical plane VP. Moreover, the lower 8 lip may protrude outwardly beyond the vertical plane VP. A portion, such as an outer wall 7*a*, of the upper lip 7 may be provided along the vertical plane VP.

The tongue 2 of the building panel 1 and a tongue groove 3 of an adjacent second edge portion 1*b* of a second building panel 1' are configured to cooperate for vertical locking.

More specifically, the tongue 2 is configured to cooperate with the upper lip 7 at upper vertical locking surfaces 12, 12' and with the lower lip 8 at lower vertical locking surfaces 13, 13'. In the locked state, the lower lip 8 may be configured to be inserted within a lip groove 9 provided in the first edge portion 1*a*, preferably provided between the strip 6 and tongue 2.

The tongue 2 comprises an upper vertical locking surface 12 and a lower vertical locking surface 13. Moreover, the upper lip 7 comprises an upper vertical locking surface 12' and the lower lip 8 comprises a lower vertical locking surface 13'. The upper 12' and lower 13' vertical locking surfaces may be provided in an upper wall 3*a* and a lower wall 3*b* of the tongue groove 3, respectively.

A horizontal extension HL of the lower vertical locking surface 13 may be larger than a horizontal extension HU of the upper vertical locking surface 12'. Thereby, a risk of a bending and/or a twisting of the second panel 1' downwards when it is subjected to load may be reduced.

The upper 12, 12' and lower 13, 13' vertical locking surfaces may be essentially parallel with the horizontal plane HP. Moreover, the upper and lower vertical locking surfaces may be offset horizontally such that the upper vertical locking surfaces 12, 12' are provided horizontally closer than the lower vertical locking surfaces 13, 13' to the locking element 4. Thereby, the assembly of panels 1, 1' by angling A may become simplified, e.g., since the area under the tongue 2 may become more accessible. In some embodiments, and as shown in, e.g., FIG. 1*c*, there may be at least one bevel 28 between the upper 12, 12' and lower 13, 13' vertical locking surfaces. For example, a horizontal distance h2 from an outer end portion 23 of the upper vertical locking surface 12 to the locking element 4 may be smaller than a horizontal distance h1 from an outer end portion 17 of the lower vertical locking surface 13 to the locking element 4. Alternatively, or additionally, a horizontal distance h2' from an inner end portion 24 of the upper vertical locking surface 12' to the locking element 4 may be smaller than a horizontal distance h1' from an inner end portion 21 of the lower vertical locking surface 13' to the locking element 4.

The vertical locking surface 12 may protrude outwardly beyond the vertical plane VP. Moreover, the vertical locking surface 13 may protrude outwardly beyond the vertical plane VP as well as inwardly of the vertical plane VP. In the locked state the vertical locking surfaces 12, 12' and 13, 13' may cooperate, preferably engage, with each other such that the vertical locking surfaces 12' and 13' essentially are situated at the location of the vertical locking surfaces 12 and 13, respectively.

In the locked state of the panels 1, 1' the outer end portion 17 of the lower vertical locking surface 13 is provided horizontally closer than an outer end portion 16 of the upper vertical locking surface 12' to the locking element 4. Alternatively, or additionally, in the locked state the inner end portion 21 of the lower vertical locking surface 13' may be provided horizontally closer than an inner end portion 22 of the upper vertical locking surface 12 to the locking element 4. In any of these embodiments, the upper 12, 12' and lower 13, 13' vertical locking surface(s) may overlap horizontally and, as a consequence, the risk and/or intensity of noise and/or creaking may be reduced. In the locked state the outer 17 and inner 21 end portions and/or the outer 16 and inner 22 end portions may be located at essentially the same position.

The outer end portions 16, 17 may be horizontal outer end portions. Thereby, the horizontal distance h1 from the outer end portion 17 to the locking element 4 may be smaller than a horizontal distance h3 from the outer end portion 16 to the locking element 4. The distance may be a distance to an inner base 4*d* of the locking element 4. It is noted that the inner end portions 21, 22 may be horizontal inner end portions.

The outer end portion 16 and/or the outer end portion 17 may be provided vertically under the upper lip 7 in the locked state. For example, the upper wall 3*a* may comprise a chamfer 3*d* for positioning the outer end portion 16 under the upper lip 7. Alternatively, or additionally, the inner end portion 21 and/or the inner end portion 22 may be provided vertically under the upper lip 7 in the locked state.

In view of the above, it is clear that the upper and lower vertical locking surface(s) 12, 13 and/or 12', 13' may overlap horizontally along a horizontal overlap HO.

The locking element 4 of the building panel 1 and a downwardly open locking groove 5 of the second building panel 1' are configured to cooperate for horizontal locking. The locking element 4 and the locking groove 5 may cooperate, such as engage, at horizontal locking surfaces 14, 14' (i.e., surfaces configured for horizontal locking), which for example may be essentially planar and, preferably, substantially parallel. The horizontal locking surface 14 and 14' may be provided in an inner portion 4*a* of the locking element and an outer portion 5*b* of the locking groove, respectively. For example, the horizontal locking surfaces 14, 14' may be provided at a locking angle LA of about 40-70°, such as 55-65°, against the horizontal plane HP.

Any, or preferably each, as illustrated in FIGS. 1*a*-1*e*, 2*a*-2*e* and 3*a*-3*d*, of the horizontal locking surfaces 14, 14' may be generally convex, such as being rounded or being composed of multiple, e.g., planar, segments, and/or being composed of at least one planar segment.

As shown in FIGS. 1*c* and 2*e*, and also conceivable in, e.g., FIG. 2*c*, in the locked state of the panels 1, 1', each of the horizontal locking surfaces 14, 14' may be spaced vertically and/or horizontally from a linking portion 10*b* in the first panel 1 provided at the inner base 4*d*.

The horizontal locking surfaces 14, 14' may extend below a horizontal strip plane HPS provided along an upper strip surface 6*a* disposed inwardly of the locking element 4. The HPS plane may be parallel with the horizontal plane HP. The upper strip surface 6*a* may be located essentially vertically under an outermost portion 2*a* of the tongue 2. Preferably, and as shown in FIG. 1*c*, the horizontal locking surfaces 14, 14' may extend entirely below the horizontal strip plane HPS.

In some embodiments, however, and as shown in FIGS. 2*a*-2*e*, the horizontal locking surfaces may be located below and/or above the horizontal strip plane HPS. For example, the locking element 4 and locking groove 5 may be embodied as described in WO 2013/191632 A1, page 21, lines 30-36, and FIGS. 3*c*-3*f*, the disclosure of which is expressly incorporated herein by reference.

The vertical locking surfaces 12, 12' and 13, 13' are offset horizontally in relation to the horizontal locking surfaces 14, 14'. In some embodiments, the horizontal locking surfaces 14, 14' may lock the first 1*a* and second 1*b* edge portions both horizontally and vertically, preferably with horizontal and/or vertical pretension.

The locking system may further comprise horizontal locking surfaces 15, 15' provided at the upper portions 1*c*, 1*d*, preferably being disposed substantially vertically. The horizontal locking surfaces 14, 14' and 15, 15' may counteract, such as prevent, separation of the panels 1, 1' and displacement of the panels 1, 1' toward each other, respectively.

As shown in FIGS. 1*a*-1*e*, 2*a*-2*e*, 3*a*-3*d* and 3*h*, the first 1*a* and second 1*b* edge portions may comprise a recess 10 and a protrusion 11, respectively. The recess 10 may be provided horizontally between the locking element 4 and an innermost portion 9*a* of the lip groove 9, preferably between the locking groove 4 and an outermost portion 2*a* of the tongue 2. The protrusion 11 may be horizontally provided between the locking groove 5 and an outermost portion 8*a* of the lower lip 8, preferably between the locking groove 5 and an innermost portion 3*c* of the tongue groove 3.

The protrusion 11 may cooperate with the recess 10 for horizontal locking. In fact, the horizontal locking surfaces 14, 14' may be provided on the protrusion and in the recess. The recess 10 and/or the protrusion 11 may comprise a planar portion 10*a*, 11*a*, preferably extending essentially in parallel with the horizontal plane HP.

In some embodiments, and as shown in, e.g., FIGS. 2*a*-2*e*, the planar portion 11*a* may form an entire underside 11*b* of the protrusion 11. Moreover, as shown in, e.g., FIGS. 2*d*-2*e*, the planar portion 10*a* may form an entire upper side 10*c* of the recess 10. The upper side 10*c* may be provided in the upper strip surface 6*a*. In some embodiments, as shown in, e.g., FIGS. 2*a*-2*c*, the upper side 10*c* may comprise two or more planar portions 10*a*.

As shown in FIG. 1*a*-1*e*, 2*a*-2*e*, 3*a*-3*d* and 3*h*, the locking element 4 and/or the protrusion 11 may comprise a bevel 18, 18'. The bevel(s) 18, 18' may provide guiding surfaces. Thereby, a simplified assembly of the panels may be facilitated. The bevels 18 and/or 18' may be substantially planar, preferably having an inclination with respect to the horizontal plane HP of about 50-60°, such as 35-45°. In the locked state the bevels 18 and 18' may be essentially parallel. Moreover, in the locked state the horizontal locking surfaces 14, 14' may be provided between the bevels 18, 18', see, e.g., FIG. 1*c*.

As shown in, e.g., FIGS. 1*a*-1*d* and 3*h*, a horizontal extension TE of the tongue 2 from the vertical plane VP may be larger than a horizontal extension LE of the lower lip 8 from the vertical plane VP and/or from the upper lip 7. Thereby, the extension of the lower vertical locking surfaces 13, 13' may be increased, e.g., even when the horizontal extension LE is kept relatively small. In addition, a reduced amount of board material for manufacturing the panels 1, 1' may be needed. Moreover, a risk of tilting of the panels 1, 1' may be reduced. Any or, preferably, each of the extensions TE and LE may be a maximal extension.

As shown in, e.g., FIGS. 2*a*-2*e*, in some embodiments, the horizontal extension LE of the lower lip 8 from the vertical plane VP and/or from the upper lip 7 may be larger than the horizontal extension TE of the tongue 2 from the vertical plane VP. Thereby, the assembly of panels 1, 1' may become further simplified, e.g., since the larger extension LE of the lower lip 8 may provide an improved guiding of the lower lip 8 into the lip groove 9.

Generally herein, the locking system may comprise a space S1, S2 between an upper portion 6*b* of the strip 6 and a lower edge portion EP of the second edge portion 1*b* in a locked state of the panels 1, 1'. At least in some embodiments, such a space may reduce or even eliminate noise and/or creaking, e.g., since portions of the locking system that may contribute to such an undesired sound may be separated from each other. At the same time, a strong vertical locking function may be provided by means of the vertical locking surfaces 12, 12', 13, 13'.

A space S1 may be provided between the upper portion 6*b* and a lower edge portion EP essentially disposed under the lower lip 8 and/or under the tongue 2 in a locked state of the panels 1, 1'; see, e.g., FIGS. 1*c*, 1*e*, 2*c* and 2*e*. Alternatively, or additionally, a space S2 may be provided between the recess 10 and the protrusion 11 in a locked state of the panels 1, 1'. In some embodiments, and as shown in FIGS. 1*c* and 2*e*, the space S1, S2 may extend under an entirety of the lower lip 8, and may extend from under the lower lip 8, such as the outermost portion 8*a*, to the horizontal locking surfaces 14, 14' and/or to the locking element 4. For example, as shown in FIG. 1*c*, the space S1, such as a maximal distance between the upper portion 6*b* and the lower edge portion EP, may be smaller than the space S2, such as a maximal distance between the recess 10 and the protrusion 11. The manufacturing of the locking system may become simplified by having a small space S1, e.g., smaller than 0.1 mm or even smaller than 0.05 mm; for example, increased dimensional tolerances between the upper portion 6*b* and the lower edge portion EP may be accepted. Also, the locking system may be able to withstand a larger load on the second panel 1', e.g., since it may be supported when the tongue 2 is bent or twisted.

It is emphasized that in some embodiments, there is no space (S1=0) between the upper portion 6*b* and the lower edge portion EP, which, for example, may be in engagement with each other. In such embodiments, a vertical load may be distributed over a larger portion of the locking system, and, consequently, the vertical locking strength of the locking system may be increased. Such embodiments may be preferred when, for example, the panels 1, 1' comprise a resilient material, preferably a thermoplastic material, such as PVC, and a filler, or when the panels 1, 1' comprise a low-density wood-based core, such as a low-density HDF board. For example, the density of the HDF board may be lower than 1000 kg/m$^3$, such as 800-1000 kg/m$^3$.

Preferably, a portion, such as an outer portion 4*b* and/or an upper portion 4*c*, of the locking element 4 is spaced from the locking groove 5, such as a lower portion 5*c* and/or an inner portion 5*a* thereof, by a space S3 and/or S4, see, e.g., FIGS. 1*c*, 1*e*, 2*c* and 2*e*. The entire upper portion 4*c* may be spaced from the lower portion 5*c*. Preferably, the space S4, such as a maximal distance between the upper portion 4*c* and the lower portion 5*c*, is larger than the space S2, such as a maximal distance between the recess 10 and the protrusion 11.

In some embodiments, however, and as shown in, e.g., FIGS. 2*a*-2*e*, the locking system may further comprise outer vertical locking surfaces 25, 25' provided horizontally outside of the tongue 2 in the locked state. Thereby, the locking system may comprise three pairs of vertical locking surfaces 12, 12', 13, 13', 25, 25'. The outer vertical locking surfaces 25, 25' may be provided in the first 1*a* and second 1*b* edge portions, respectively, preferably being disposed vertically below the tongue 2.

As shown in FIGS. 2*a*-2*c*, the outer vertical locking surfaces 25, 25' may extend, preferably entirely, inwardly of the locking element 4 in the locked state. The surface 25 may be provided in the strip 6, preferably in the upper strip surface 6*a*, and the surface 25' may be provided in the underside 11*b*. The outer vertical locking surfaces 25, 25' may engage with each other along a width portion W' along a transverse direction T of the first edge portion 1*a* and hence of the strip 6. For example, the width portion W' may be larger than 0.10 times, such as larger than 0.30 times, a strip width W of the strip 6. By means of the width portion W', a risk of a bending and/or a twisting of the second panel 1' downwards when it is subjected to load may be reduced. The strip width W may be an extension from the vertical plane VP to an outermost portion 6*c* of the strip, such as the outer portion 4*b*. The space S1 may be provided horizontally inwardly of the outer vertical locking surfaces 25, 25'.

As shown in FIGS. 2*d*-2*e*, in some embodiments the outer vertical locking surfaces 25, 25' may be provided in the upper portion 4*c* of the locking element 4 and in the lower portion 5*c* of the locking groove 5. The upper 4*c* and/or the lower 5*c* portion may be planar, preferably being essentially parallel with the horizontal plane HP.

In some embodiments, such as shown in FIGS. 2*a*-2*e*, a thickness TS of a portion of the strip 6, such as at the location of the vertical locking surface 25, may be at least 0.3 times, preferably at least 0.4 times, a thickness T1 of the panel 1. In such embodiments, the risk of bending and/or twisting of the strip may be reduced, which, in turn, may reduce the risk and/or intensity of noise and/or creaking. Also, the higher up the locking system is provided, the easier the assembly of the panels 1, 1' may become. In the embodiments in FIGS. 2*d*-2*e*, the thickness TS, such as at the location of the vertical locking surface 25, may even be larger than 0.5 times the thickness T1.

In some embodiments, such as shown in FIGS. 2*a*-2*e*, a thickness T2 of the tongue 2 may be less than 0.2 times, preferably less than 0.15 times, the thickness T1. Such a thin tongue may simplify the assembly of the panels 1, 1'.

As shown in FIG. 1*d*, the locking system may comprise guiding surface(s) 19*a*, 19*b*, 19*a'*, 19*b'*, optionally being provided as bevel(s), and optionally being configured to cooperate, such as engage, with a corresponding panel surface during assembling of the panels, preferably during angling A. For example, the guiding surface(s) may be provided on the tongue 2 and the lower lip 8 and/or may be provided as bevel(s) as described above with regard to the bevel(s) 18, 18'. The guiding surfaces may be inclined with respect to the vertical VP and/or the horizontal HP plane and may be located in an upper and/or a lower portion of the tongue 2 and the lower lip 8. It is noted that the tongue groove 3 and/or the lip groove 9 may comprise surfaces having shapes corresponding to shapes of the guiding surfaces 19*a*, 19*b*, 19*a'*, 19*b'*.

As illustrated in FIGS. 3*a*-3*d*, the first 1*a* and second 1*b* edge portions preferably are provided on long side edges of the panels 1, 1', 1", and the panels may further comprise a third 1*a'* and a fourth 1*b'* edge portion, preferably being short side edges. The panels may be configured to be assembled by angling A and/or horizontal displacement HD on the long side edges and by a vertical folding displacement FD on short side edges. FIGS. 3*e*-3*g* schematically illustrate embodiments of the third 1*a'* and fourth 1*b'* edge portions of a panel 1 and of an adjacent panel 1'", respectively, which may be combined with any of the embodiments in, e.g., FIGS. 1*a*-1*e*, 2*a*-2*e*, 3*a*-3*d* and 3*h*.

The third edge portion 1*a'* may comprise a, preferably separate and flexible, tongue 2' and a locking element 4' provided on a strip 6'. The separate and flexible, tongue 2' may be displaceably arranged in an insertion groove 9'. The strip 6' extends horizontally beyond an upper portion 1*c'* of the third edge portion 1*a*1. The fourth edge portion 1*b'* may comprise a tongue groove 3' and a downwardly open locking groove 5'.

For example, as shown in the non-limiting embodiment in FIG. 3*g*, the tongue 2' may comprise flexible members 26 that are bendable between an inner 26*a* and an outer 26*b* position. Thereby, the tongue may be displaceable between an inner and an outer position. An inwardly directed pressure applied on the tongue 2' may displace it inwards toward the inner position and the flexible members 26 may be configured to displace it outwards toward its outer position, e.g., by virtue of a biasing force of the flexible members 26. Preferably, the tongue 2' is formed by injection moulding. Optionally, the tongue 2' comprises at least one friction element 27 for preventing it from being displaced out from the insertion groove 9'.

The tongue 2' and the tongue groove 3' are configured to cooperate for vertical locking while the locking element 4' and the locking groove 5' are configured to cooperate for horizontal locking. It is understood that a separate and flexible tongue 2' is not shown in FIGS. 3*a*-3*d*, but that the panel 1 shown therein is configured to be provided with such a tongue 2' in the insertion groove 9'.

The disclosure has mainly been described above with reference to a few embodiments. However, as is readily appreciated by a person skilled in the art, other embodiments than the ones disclosed above are equally possible within the scope of the disclosure. For example, an ordinarily skilled artisan will appreciate that, within the scope of the present disclosure, embodiments and examples of the panel 1 disclosed herein are equally conceivable for the other panels 1', 1", etc., and vice versa. In addition, in some exemplary embodiments, FIGS. 1*a*-1*d*, 2*a*-2*e* and 3*a*-3*h* represent drawings that are drawn to scale.

EMBODIMENTS

Item 1. Building panels comprising a locking system for vertical and horizontal locking of a first edge portion (1*a*) of a first building panel (1) to an adjacent second edge portion (1*b*) of a second building panel (1'), wherein upper portions (1*c*, 1*d*) of the first and second edge portions in a locked state of the first and second building panels (1, 1') together define a vertical plane (VP) perpendicular to a horizontal plane (HP), which is parallel to a front side (1*e*) and/or a rear side (1*f*) of the building panels (1, 1'), wherein the locking system comprises a tongue (2) provided in the first edge portion (1*a*) and a tongue groove (3) provided in the second edge portion (1*b*), the tongue (2) and the tongue groove (2) being configured to cooperate for vertical locking, the tongue groove (3) comprising an upper lip (7) and a lower lip (8), wherein the tongue (2) is configured to cooperate with the upper lip (7) at upper vertical locking surfaces (12, 12') and with the lower lip (8) at lower vertical locking surfaces (13, 13'), wherein the locking system comprises a locking element (4) provided in the first edge portion (1*a*) and a downwardly open locking groove (5) provided in the second edge portion (1*b*), the locking element (4) and the downwardly open locking groove (5) being configured to cooperate for horizontal locking, said locking element (4) being provided on a strip (6) extending beyond the upper portion (1*c*) of the first edge portion (1*a*), and wherein the locking system further comprises outer vertical locking surfaces (25, 25') provided horizontally outside of the tongue (2) in said locked state.

Item 2. The building panels according to item 1, wherein the outer vertical locking surfaces (25, 25') extend inwardly of the locking element (4) in the locked state.

Item 3. The building panels according to item 1 or 2, wherein the outer vertical locking surfaces (25, 25') are provided in an upper portion (4*c*) of the locking element (4) and in a lower portion (5*c*) of the locking groove (5).

Item 4. The building panels according to any of the preceding items, wherein the outer vertical locking surfaces (25, 25') engage with each other along a width portion (W') along a transverse direction (T) of the first edge portion (1*a*), the width portion (W') preferably being larger than 0.10 times, such as larger than 0.30 times, a strip width (W) of the strip (6).

Item 5. The building panels according to any of the preceding items, wherein the lower lip (8) protrudes horizontally beyond the upper lip (7).

Item 6. The building panels according to any of the preceding items, wherein a horizontal extension (HL) of the lower vertical locking surface(s) (13, 13') of the tongue (2) and/or of the lower lip (8) is larger than a horizontal extension (HU) of the upper vertical locking surface(s) (12', 12) of the upper lip (7) and/or of the tongue (2).

Item 7. The building panels according to any of the preceding items, wherein the locking element (4) and the locking groove (5) cooperate at horizontal locking surfaces (14, 14').

Item 8. The building panels according to item 7, wherein each of the horizontal locking surfaces (14, 14') is essentially planar.

Item 9. The building panels according to item 7 or 8, wherein in the locked state of the building panels (1, 1') each of the horizontal locking surfaces (14, 14') is spaced vertically and/or horizontally from a linking portion (10*b*) in the first building panel (1) provided at an inner base (4*d*) of the locking element (4).

Item 10. The building panels according to any of the preceding items 7-9, wherein the horizontal locking surfaces (14, 14') extend, such as extend entirely, below a horizontal strip plane (HPS) provided along an upper strip surface (6*a*) disposed inwardly of the locking element (4).

Item 11. The building panels according to any of the preceding items, wherein the locking element (4) and/or a protrusion (11) of the second edge portion (1*b*) comprises a bevel (18, 18'), said protrusion (11) being configured to be provided in a recess (10) of the first edge portion (1*a*).

Item 12. The building panels according to any of the preceding items, wherein said locking system is configured to assemble the first (1*a*) and second (1*b*) edge portions by angling (A) of the first (1) and second (1') building panels relative each other and/or by a horizontal displacement (HD) of the first (1) and second (1') panels towards each other.

Item 13. The building panels according to any of the preceding items, wherein the tongue (2) and/or the strip (6) is formed in one piece with a core (20) of the building panels (1, 1').

Item 14. The building panels according to any of the preceding items, wherein a horizontal extension (TE) of the tongue (2) from the vertical plane (VP) is larger than a horizontal extension (LE) of the lower lip (8) from the vertical plane (VP) and/or the upper lip (7), or wherein the horizontal extension (LE) of the lower lip (8) from the vertical plane (VP) and/or the upper lip (7) is larger than the horizontal extension (TE) of the tongue (2) from the vertical plane (VP).

Item 15. The building panels according to any of the preceding items, wherein the upper (12, 12') and lower (13, 13') vertical locking surfaces are essentially parallel with the horizontal plane (HP).

Item 16. The building panels according to any of the preceding items, wherein the upper (12, 12') and lower (13, 13') vertical locking surfaces are offset horizontally such that the upper vertical locking surfaces (12, 12') are provided horizontally closer than the lower vertical locking surfaces (13, 13') to the locking element (4).

Item 17. The building panels according to any of the preceding items, wherein the locking system comprises a space (S1, S2) between an upper portion (6*b*) of the strip (6) and a lower edge portion (EP) of the second edge portion (1*b*).

Item 18. The building panels according to item 17, wherein the space (S1, S2) extends under an entirety of the lower lip (8), and from under the lower lip (8) to the locking element (4).

Item 19. The building panels according to any of the preceding items, wherein a core (20) of each of the building panels is a wood-based core, such as comprising an HDF board, a particle board or a plywood material, a polymer-based core, such as comprising a thermoplastic material or a thermosetting material, or a mineral-based core.

Item 20. The building panels according to any of the preceding items, wherein a thickness (TS) of a portion of the strip (6), such as at the location of the vertical locking surface (25), is at least 0.3 times, preferably at least 0.4 times, a thickness (T1) of the first building panel (1).

Item 21. The building panels according to any of the preceding items, wherein a thickness (T2) of the tongue (2) is less than 0.2 times, preferably less than 0.15 times, a thickness (T1) of the first building panel (1).

The invention claimed is:

1. Building panels comprising a locking system for vertical and horizontal locking of a first edge portion of a first building panel to an adjacent second edge portion of a second building panel, wherein upper portions of the first and second edge portions in a locked state of the first and second building panels together define a vertical plane perpendicular to a horizontal plane, which is parallel to a front side and/or a rear side of the building panels, wherein the locking system comprises a tongue provided in the first edge portion and a tongue groove provided in the second edge portion, the tongue and the tongue groove being configured to cooperate for vertical locking, the tongue groove comprising an upper lip and a lower lip protruding horizontally beyond the upper lip, wherein, in the locked state of the first and second building panels, the tongue is configured to contact the upper lip at respective upper vertical locking surfaces of the tongue and of the upper lip and is configured to contact the lower lip at respective lower vertical locking surfaces of the tongue and of the lower lip, wherein the locking system comprises a locking element provided in the first edge portion and a downwardly open locking groove provided in the second edge portion, the locking element and the downwardly open locking groove being configured to cooperate for horizontal locking, said locking element being provided on a strip extending beyond the upper portion of the first edge portion, wherein, in the locked state of the first and second building panels, a total horizontal extension of contact between the respective lower vertical locking surfaces of the tongue and of the lower lip extends from contact at an inner end portion of the lower vertical locking surface of the lower lip and an outer end portion of the lower vertical locking surface of the tongue to contact at an outer end portion of the lower vertical locking surface of the lower lip and an inner end portion of the lower vertical locking surface of the tongue, wherein, in the locked state of the first and second building panels, a total horizontal extension of contact between the respective upper vertical locking surfaces of the upper lip and of the tongue extends:

from contact at an inner end portion of the upper vertical locking surface of the upper lip and an outer end portion of the upper vertical locking surface of the tongue to contact at an outer end portion of the upper vertical locking surface of the upper lip and an inner end portion of the upper vertical locking surface of the tongue, wherein, in the locked state of the first and second building panels:

(i) the outer end portion of the lower vertical locking surface of the tongue is provided horizontally closer than the outer end portion of the upper vertical locking surface of the upper lip to the locking element; and/or (ii) the inner end portion of the lower vertical locking surface of the lower lip is provided horizontally closer than the inner end portion of the upper vertical locking surface of the tongue to the locking element, wherein the locking system further comprises outer vertical locking surfaces provided horizontally outside of the tongue in the locked state, wherein, in the locked state of the first and second building panels, the total horizontal extension of contact between the respective lower vertical locking surfaces of the tongue and of the lower lip is larger than the total horizontal extension of contact between the respective upper vertical locking surfaces of the upper lip and of the tongue, and wherein, in the locked state of the first and second building panels, the upper and lower vertical locking surfaces are offset horizontally such that the upper vertical locking surfaces are provided horizontally closer than the lower vertical locking surfaces to the locking element.

2. The building panels according to claim 1, wherein the outer vertical locking surfaces are provided in the first and second edge portions, respectively.

3. The building panels according to claim 2, wherein the outer vertical locking surface of the first edge portion is provided in the strip and wherein the outer vertical locking surface of the second edge portion is provided in an underside of a protrusion of the second edge portion provided horizontally between the locking groove and an outermost portion of the lower lip.

4. The building panels according to claim 2, wherein a thickness of a portion of the strip at the location of the outer vertical locking surface of the first edge portion is at least 0.3 times a thickness of the first building panel.

5. The building panels according to claim 1, wherein the outer vertical locking surfaces are provided in an upper portion of the locking element and in a lower portion of the locking groove.

6. The building panels according to claim 1, wherein the outer vertical locking surfaces are disposed vertically below the tongue.

7. The building panels according to claim 1, wherein the outer vertical locking surfaces extend inwardly of the locking element in the locked state.

8. The building panels according to claim 1, wherein the outer vertical locking surfaces engage with each other along a width portion along a transverse direction of the first edge portion, the width portion being larger than 0.10 times a strip width of the strip.

9. The building panels according to claim 1, wherein the locking element and the locking groove cooperate at horizontal locking surfaces.

10. The building panels according to claim 9, wherein in the locked state of the building panels each of the horizontal locking surfaces is spaced vertically and/or horizontally from a linking portion in the first building panel provided at an inner base of the locking element.

11. The building panels according to claim 9, wherein the horizontal locking surfaces extend entirely below a horizontal strip plane provided along an upper strip surface disposed inwardly of the locking element.

12. The building panels according to claim 1, wherein said locking system is configured to assemble the first and second edge portions by angling of the first and second building panels relative to each other and/or by a horizontal displacement of the first and second panels towards each other.

13. The building panels according to claim 1, wherein the tongue and/or the strip is formed in one piece with a core of the building panels.

14. The building panels according to claim 1, wherein the upper and lower vertical locking surfaces are essentially parallel with the horizontal plane.

15. The building panels according to claim 1, wherein the locking system comprises a space between an upper portion of the strip and a lower edge portion of the second edge portion.

16. The building panels according to claim 15, wherein the space extends under an entirety of the lower lip, and from under the lower lip to the locking element.

17. The building panels according to claim 15, wherein the space is provided horizontally inwardly of the outer vertical locking surfaces.

18. The building panels according to claim 1, wherein a core of each of the building panels is a wood-based core, a polymer-based core, or a mineral-based core.

* * * * *